US007428762B1

(12) United States Patent
Kalies

(10) Patent No.: US 7,428,762 B1
(45) Date of Patent: Sep. 30, 2008

(54) FOLDABLE PLATFORM

(76) Inventor: Kevin Kalies, N3028 County Hwy., New London, WI (US) 54961

( * ) Notice: Subject to any disclaimer, the term of this patent is extended or adjusted under 35 U.S.C. 154(b) by 0 days.

(21) Appl. No.: 11/293,691

(22) Filed: Dec. 5, 2005

(51) Int. Cl.
*A61G 1/013* (2006.01)

(52) U.S. Cl. ..... 5/627; 5/626; 5/625; 280/32.5; 182/223; 182/152; 296/20

(58) Field of Classification Search ..... 5/625, 5/626, 627, 628, 629; 280/32.5, 400; 182/222, 182/119, 223, 152, 153, 224, 225, 28, 33, 182/35, 20, 116; 16/45; 296/20; 108/50.12, 108/12, 166, 171, 14, 18
See application file for complete search history.

(56) References Cited

U.S. PATENT DOCUMENTS

| | | | | |
|---|---|---|---|---|
| 3,336,060 | A * | 8/1967 | Bradford | 403/108 |
| 4,389,066 | A | 6/1983 | Weir et al. | |
| 4,579,381 | A * | 4/1986 | Williams | 296/20 |
| 5,217,315 | A * | 6/1993 | Rosane | 403/102 |
| 5,283,919 | A * | 2/1994 | Grant | 5/620 |
| 5,368,126 | A * | 11/1994 | Woodward et al. | 182/152 |
| 5,502,854 | A * | 4/1996 | Daouk | 5/627 |
| 5,598,592 | A * | 2/1997 | Castellani | 5/627 |
| 5,611,552 | A * | 3/1997 | Miles et al. | 280/32.6 |
| 5,711,400 | A * | 1/1998 | Tan | 182/119 |
| 6,276,698 | B1 * | 8/2001 | Calandra | 280/19 |
| 6,398,479 | B1 * | 6/2002 | Dupuy et al. | 414/540 |
| 6,705,234 | B1 * | 3/2004 | Miller et al. | 108/36 |
| 6,871,861 | B2 * | 3/2005 | Hernandez, Jr. | 280/32.6 |
| 7,043,785 | B2 * | 5/2006 | Dimentmen | 5/627 |
| 7,210,560 | B2 * | 5/2007 | Brink | 182/222 |
| 2005/0225044 | A1 * | 10/2005 | Brink | 280/32.5 |
| 2006/0130715 | A1 * | 6/2006 | Yoo et al. | 108/116 |

* cited by examiner

*Primary Examiner*—J. A Shriver
(74) *Attorney, Agent, or Firm*—Russell L. Johnson Patent Agent

(57) ABSTRACT

A telescoping folding platform that is compact in the retracted and folded configuration and that is made rigid and locked in the unfolded and extended configuration by means of spring biased securements that are incorporated into the structures of the platform. The platform can be given numerous utilitarian embodiments by means of attachments that are locked in place in securements that are incorporated into the structures of the platform. When the attachments are wheels and a drawbar the platform is configured as a cart which has particular utility in off the road emergency rescue situations.

4 Claims, 6 Drawing Sheets

FOLDABLE PLATFORM

BACKGROUND

This invention relates to telescoping and foldable platforms that can be carried by an off-the-road vehicle and assembled at a remote location.

More specifically, this invention relates to foldable cart platforms as described above wherein the cart is of particular utility in rescue operations.

Still more specifically, this invention relates to a foldable cart platform as described above wherein the cart is provided with structural and utilitarian components that are associated to the cart platform in a knocked down configuration and which can be securely deployed at a location where they are needed.

HISTORY OF THE INVENTION

The popularity of recreational and other activities in remote areas that are not accessible by means of road vehicles has increased the need for a carrier that can be transported to a remote location by an off-the-road vehicle such as an all terrain vehicle, a snow mobile or the like. Such a carrier has utilities for hunters and back country campers, but such a carrier has particular importance for emergency rescue operations in remote locations.

An emergency rescue cart for use in conjunction with an off-the-road vehicle has requirements associated with the rescue aspect of the cart and with the transport aspect of the cart. It is most desirable to transport an injured party on a back board or in a transport basket. Therefore, it is desirable that the platform of the cart should serve as a backboard or carrier basket to transport an injured person over rough terrain.

A cart that can be knocked down and be carried by an off-the-road vehicle and then assembled quickly and reliably at the point of need is highly desirable. The components of the cart should be locked securely in place both in the knocked down configuration and in the assembled configuration and there should be no essential components that can become separated from the cart or lost. Further the cart should facilitate the administering of emergency medical treatment on the cart and during transport. Still further the cart should have a means for connecting the cart to a variety of towing connections and be capable of providing means for pulling or carrying the cart by hand.

It is an object of this invention to meet the requirements listed above.

Further objects will be made apparent by the following specifications, drawings and claims.

BRIEF DESCRIPTION OF THE PRIOR ART

The prior art is replete with foldable carriers that can be transported to a location of need and assembled for use there. The prior art is replete with carriers that can be towed by off-the-road vehicles.

This invention is for a novel foldable platform for a carrier or support that can be given multiple embodiments by securing attachments to the platform by means of receivers and locking means incorporated into the structure of the platform.

U.S. Pat. No. 6,276,698 to Calandra teaches a tote frame which can be disassembled for transport and having a flexible carrier surface and the tote can be towed by an off-the-road vehicle.

U.S. Pat. No. 4,389,066 to Weir et al. teaches a rescue unit that has a telescoping frame and is towable by off-the-road vehicles.

The platform of this invention is foldable and telescoping and has securements for attachments incorporated into the structure of the platform so that a means for securely locking attachments to the platform is provided as a part of the platform. When the attachments are surface engaging means such as wheels or skis and a drawbar, the platform serves particularly well as an emergency rescue platform and cart.

BRIEF DESCRIPTION OF THE INVENTION

The basic invention comprises a foldable platform having a first rectangular frame and a second rectangular frame and the rectangular frames have tubular side members that are joined to each other at their ends by frame end members transverse to the side members, hinges joining the first frame to the second frame so that the tubular side members form continuous tubes when the hinges are open and the first frame overlays the second frame when the hinges are closed, first and second end extensions having parallel legs joined at one of their ends to a transverse end member and the parallel legs reside inside the tubular side members of the first and second rectangular frames to form telescoping frame end extensions when the hinges are open, first and second locking beams that are slidably positioned inside the tubular side members on each side of the second frame member, first and second resilient springs that reside inside the second frame member and the springs are attached at one end to the parallel legs of the second end extension and at their other ends to the first and second locking beams so the springs resiliently retract the first and second locking beams into the tubular side members of the second frame member when the first end extension is in a retracted position, first and second flexible cables joining the locking beams to the free ends of the parallel legs of the first end extension and the length of the cables is such that the locking beams will be drawn into a position in the tubular side members spanning the seam between the first frame member and the second frame member when the tubular side members of the frame members are in alignment and the first end extension is in an extended position, and a locking means secured to the first and second frame members for positively locking the first and second end extensions into their extended positions to form a rigid platform.

The platform is provided with multiple securements which enable the securing of attachments to the platform. The compactness and portability of the platform recommends it for use in emergency rescue operations

DETAILED DESCRIPTION

Figure 1:
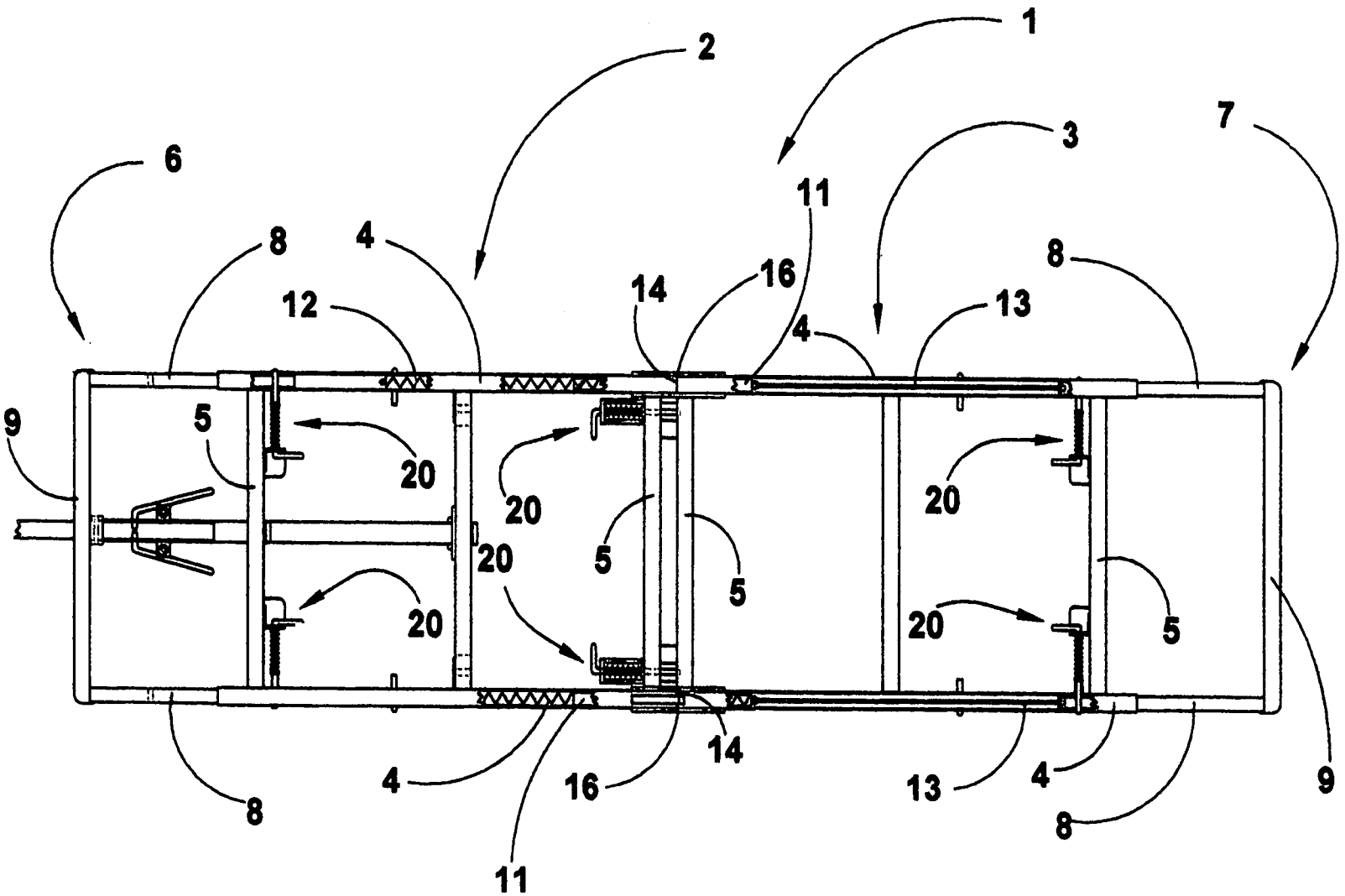
FIG. 1 is a plan view of the platform of this invention in the open and locked configuration.

In the drawings like numbers refer to like objects and the proportions of some of the components have been modified to facilitate illustration.

The term securement as used herein shall be understood to mean, "A means for securely joining an attachment to the platform of this invention".

The term "attachment" as used herein shall be read to mean, "a component that can be joined to and removed from a securement that is a part of the platform of this invention".

The platform of this invention is characterized by its compactness in the folded configuration, and by its sturdiness in the open and locked configuration.

The platform of this invention can serve as the platform component in many diverse applications, but the properties of compactness in the folded configuration and sturdiness in the open and locked configuration make it of particular value in emergency rescue and disaster situations.

The following descriptions will disclose the platform of this invention in detail and then disclose the platform incorporated into an emergency cart embodiment of the platform.

Figure 2:
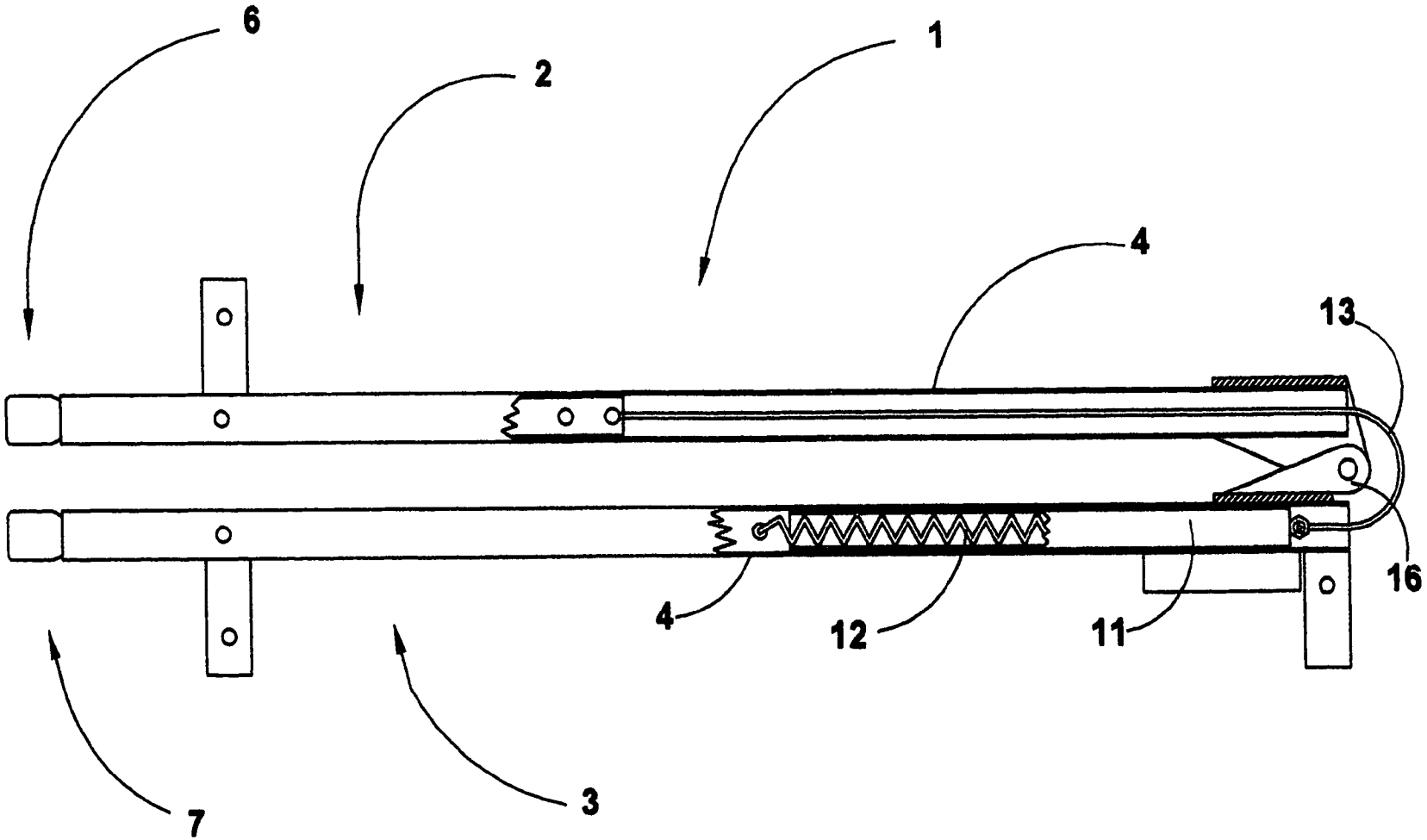
FIG. 2 is an elevation view of the platform of FIG. 1 in the folded configuration.

FIGS. 1 and 2 illustrate the essential components of the invention schematically.

Foldable platform 1 comprises; a first rectangular frame 2 and a second rectangular frame 3 and rectangular frames 2 and 3 have tubular side members 4 that are joined to each other at their ends by frame end members 5 transverse to the side members 4. Hinges 16 join first frame 2 to second frame 3 so that tubular side members 4 form a continuous tube when hinges 16 are open as shown in FIG. 1, and first frame 2 overlays second frame 3 when hinges 16 are closed, as shown in FIG. 2.

First end extension 6 and second end extensions 7 have parallel legs 8 joined at one of their ends to transverse end member 9 and the parallel legs 8 reside inside the tubular side members 4 of the first and second rectangular frame members 2 and 3 to form telescoping frame end extensions 6 and 7 respectively.

First and second locking beams 11 are slidably positioned inside tubular side members 4 on each side of second frame member 3.

First and second resilient springs 12 reside inside the second frame member 3 and resiliently retract first and second locking beams 11 into the tubular side members 4 of second frame member 3.

First and second flexible cables 13 joining locking beams 11 to the free ends or parallel legs 8 of the first end extension 6 and the length of the cables is such that locking beams 11 will be drawn into a position in the tubular side members 4 spanning the seam 14 between the first frame 2 and second frame 3 when the tubular side members 4 of the frames 2 and 3 are in alignment and first end extension 6 is in an extended position.

A locking means 20 is attached to frame members 2 and 3 for positively locking the first and second end extensions 6 and 7 into their extended positions to form a rigid platform.

Figure 3:
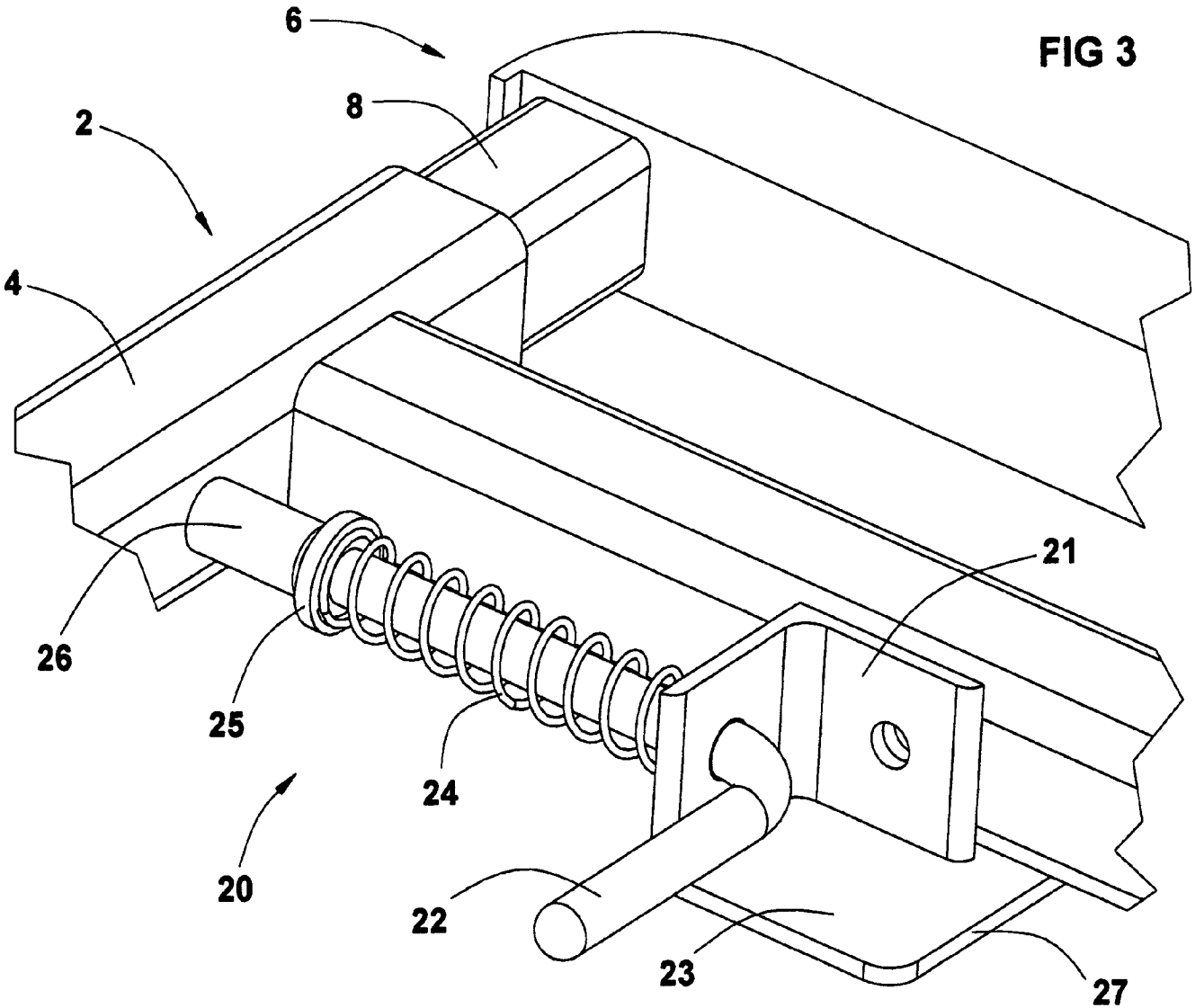
FIG. 3 is a fragmentary pictorial view of the locking means of FIGS. 1 and 2.

In FIG. 3, body 21 of locking means 20 is incorporated into the structure of frame member 2 as by welding and the like. L-shaped pin 22 is provided with resilient spring 24 which is compressed between fixed washer 25 and body 21 as shown in FIG. 3. L-shaped pin 22 is held against the pressure exerted by spring 24 by being engaged with pad 23. Pin 22 is rotated to permit pin 22 to advance into receiver 26 in tubular side member 4 and into a hole (not shown) in leg 8 of end extension 6 to lock extension 6 in the extended position.

Platform 1 in the extended and locked configuration illustrated in FIG. 1 is rigid and strong. Platform 1 in the retracted and folded configuration illustrated in FIG. 2 is compact and readily stored or transported. These attributes recommend platform 1 for use in embodiments that have roles in disaster and emergency rescue situations. A partial list of such embodiments would include; litters, stretchers, pallets, cots, tables and carts. To achieve these and other useful embodiments, it is necessary to provide platform 1 with additional securements for securing attachments to the platform of this invention. While these securements and the attachments that engage the securements are diverse they can be categorized into four broad categories: surface contacting attachments, support surfaces, connections, and specific utilities.

Platform 1 is provided with a multiplicity of permanently attached securements which receive and lock in place the attachments that will combine with platform 1 to form a specific embodiment of platform 1.

EXAMPLE

Figures 4, 5:
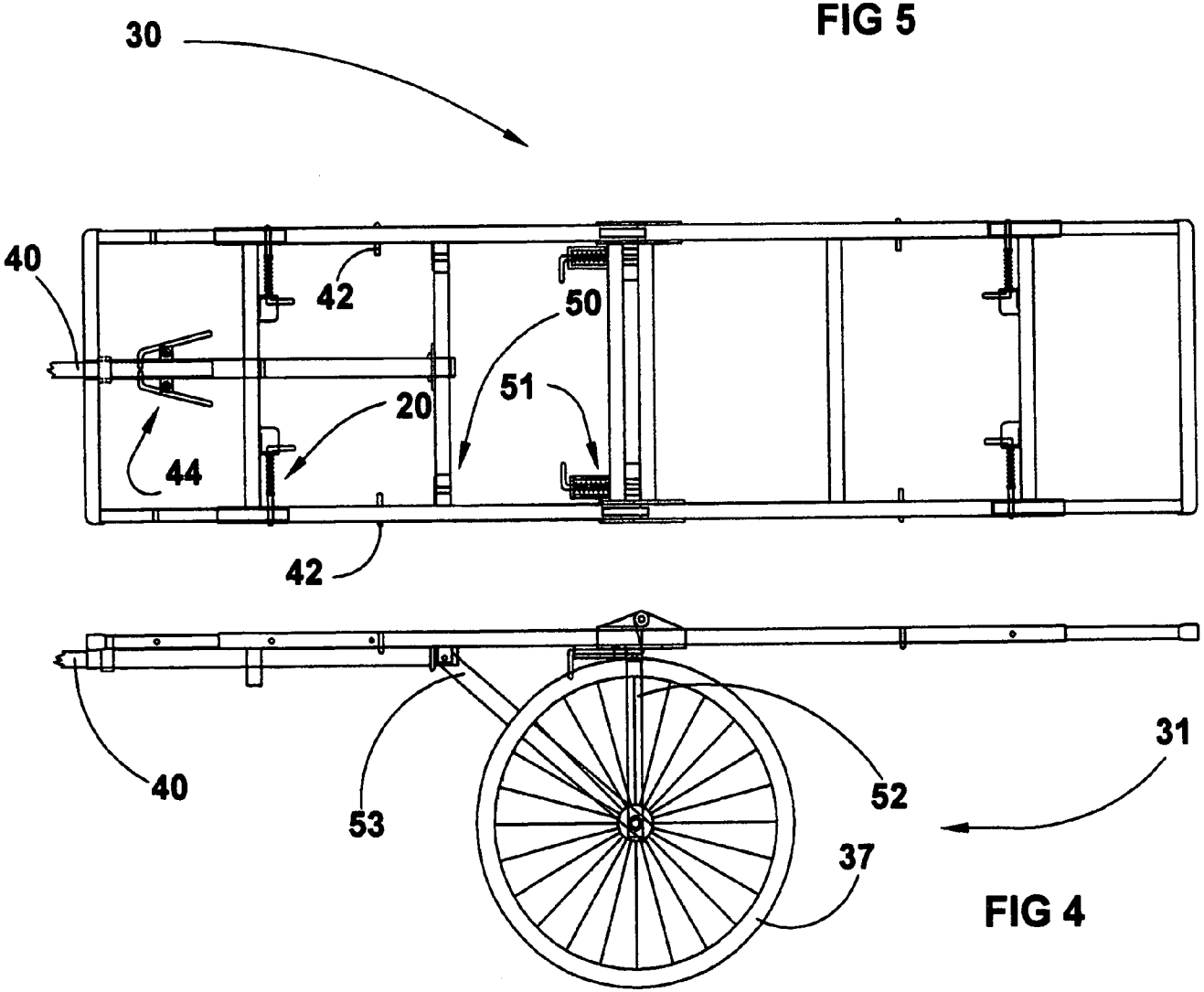
FIG. 4 is an elevation view of the platform of this invention in the form of a cart.
FIG. 5 is a plan view of the cart of FIG. 4.
Figure 6:
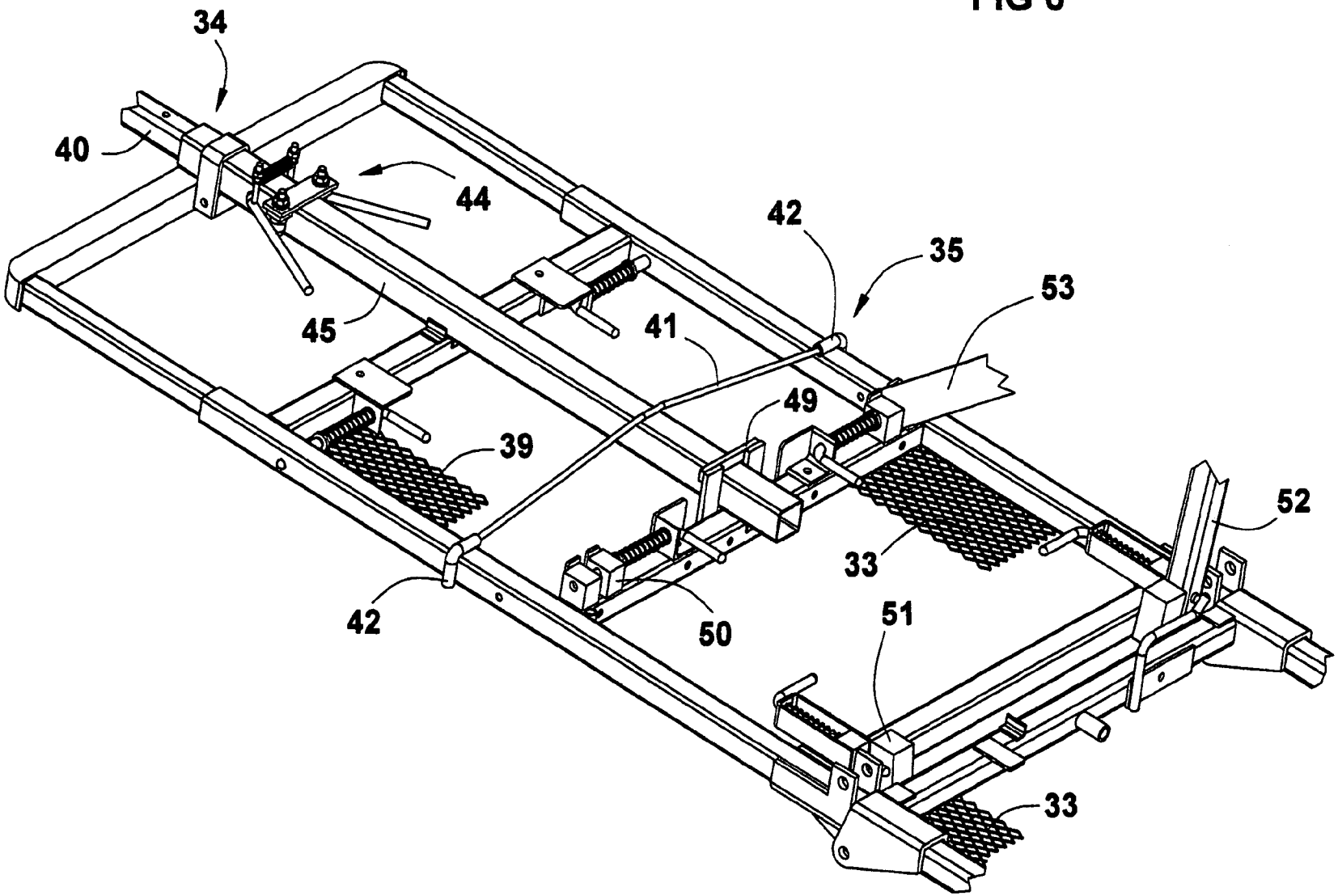
FIG. 6 is a fragmentary pictorial view of the platform of this invention showing the securements for the cart of FIGS. 4 and 5.
Figure 7:
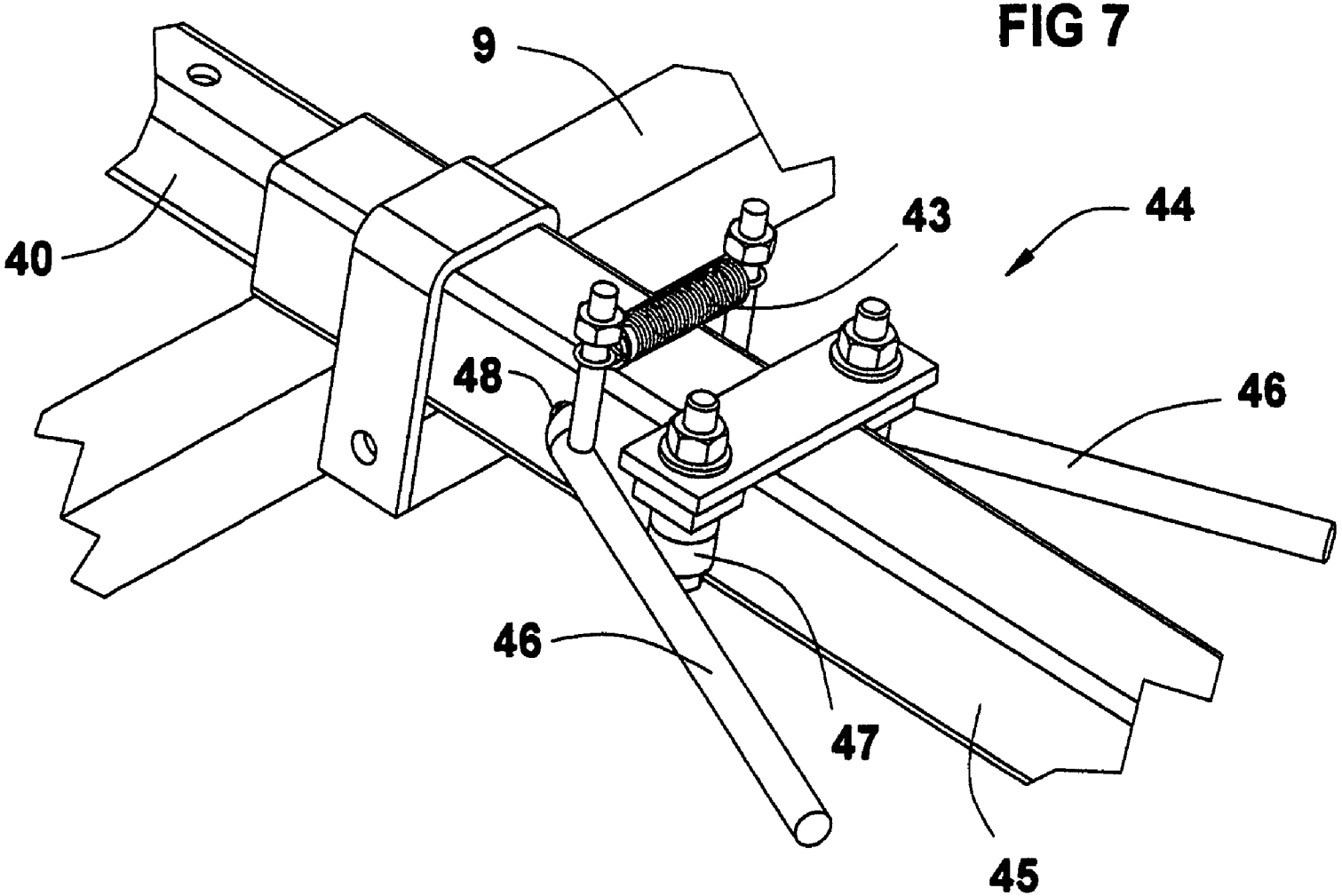
FIG. 7 is a fragmentary pictorial view of a drawbar receiver and caliper securement for the cart of FIGS. 4 and 5.

FIGS. 4, 5 and 6 illustrate an emergency rescue cart embodiment of the platform of FIGS. 1-3 which have typical securements and attachments. The typical securement is permanently attached to platform 1 and the typical attachment can be secured to and locked in place in the securements and unlocked from and removed from platform 1 manually without the need for any tools. Typically the securement is permanently attached to the platform as by welding. The securements can be removably attached as by threaded fasteners, but permanent attachment is preferred.

Cart 30 as shown in FIGS. 4 through 6 comprises in part; foldable platform 1 in the extended and locked configuration, surface contacting attachments 31 and 32, support surfaces 33, connection 34, and specific utility 35.

Surface contacting attachments are here shown to be, detachable wheels 37. Support surface 33 is here shown to be an expanded metal screen 39. secured to platform 1 by welding or by threaded fasteners. Connection 34 is here shown to be a detachable draw bar 40. A specific utility is here shown to be a tie-down 41 secured in tubular tie-down guides 42 which are secured to platform 1 by means of welding.

Securements 50 and 51 serve to receive and lock in place leg 52 and strut 53 of wheel 37. Securements 50 and 51 are similar in construction and function to locking means 20. Caliper securement 44 serves to lock drawbar 40 in drawbar receiver 45. Locking means 20 and securements 44, 50 and 51 are incorporated into the structures of platform 1. Attachments are secured to platform 1 by retracting the pins against a spring pressure, placing the attachment in the receiver portion of the securement, aligning holes in the receiver and the attachment and releasing the pin to pass into the aligned holes to lock the attachment in the securement. Pressure from the spring maintains the pin in locking engagement with the attachment.

Caliper securement differs from locking means 20 and securements 50 and 51 in its construction, but its function and mode of operation is the same. Caliper securement 44 is secured to drawbar receiver 45 and pins 46 pivot on pivots 47 to insert and retract pins 46 from holes 48 so that pins 46 can engage holes (not shown) in draw bar 40. Pins 46 are maintained in engagement with drawbar 40 by means of spring 43. Drawbar receiver 45 is secured to transverse end member 9 and is free to slide in guide 49.

When serving as an emergency rescue unit, as for instance to rescue a wilderness camper who has fallen into a ravine that is inaccessible by road or air, the platform of this invention can be carried in the retracted and folded configuration in a back pack or in a carrying case. Platform 1 can serve as a stretcher which can be man handled to the nearest point that is accessible by an off-the-road vehicle at which point wheels 37 and draw bar 40 can be quickly attached and platform 1 can be converted into cart 30 which can be towed to the nearest road or air access point.

The above disclosures and examples are enabling and would permit one skilled in the art to make and use the invention without undue experimentation. The platform of this invention, by design, can serve many utilities and be given many embodiments. To disclose all the variants of this invention would greatly multiply the drawings and claims and cause the specifications to become prolix. Therefore, it should be understood that the scope of this invention should not be limited to the embodiments and examples provided. The scope of this invention should only be limited by the scope of the appended claims and all equivalents thereto which would be made obvious thereby to one skilled in the art.

What is claimed is:

1. A foldable platform comprising;

a) a first rectangular frame and a second rectangular frame and the rectangular frames have tubular side members that are joined to each other at their ends by frame end members transverse to the side members, b) hinges joining the first frame to the second frame so that the tubular side members form continuous tubes when the hinges are open and the first frame overlays the second frame when the hinges are closed, c) first and second end extensions having parallel legs joined at one of their ends to a transverse end member and the parallel legs reside inside the tubular side members of the first and second rectangular frames to form telescoping frame end extensions when the hinges are open, d) first and second locking beams that are slidably positioned inside the tubular side members on each side of the second rectangular frame, e) first and second resilient springs that reside inside the second rectangular frame and the springs are attached at one end to the parallel legs of the second end extension and at their other ends to the first and second locking beams so the springs resiliently retract the first and second locking beams into the tubular side members of the second rectangular frame when the first end extension is in a retracted position, f) first and second flexible cables joining the locking beams to the free ends of the parallel legs of the first end extension and the length of the cables is such that the locking beams will be drawn into a position in the tubular side members spanning the seam between the rectangular first frame and the rectangular second frame when the tubular side members of the first and second rectangular frame are in alignment and the first end extension is in an extended position, and g) a locking means secured to the first and second rectangular frame for positively locking the first and second end extensions into their extended positions to form a rigid platform.

2. The platform of claim 1 wherein the platform has a multiplicity of securements attached thereto for securing attachments to the platform, and the securements have receivers for receiving attachments and a means for reversibly locking the attachment in place in the receivers.

3. The platform of claim 2 wherein the receiver is provided with holes that align with holes in an attachment part inserted in the receiver and the securement has at least one pin that is guided through the aligned holes to lock the attachment part in the receiver.

4. The platform of claim 3 wherein the securement has a body secured to the platform and a pin guiding means as a part of the body and a spring attached to the pin that resiliently holds the pin in engagement with the aligned holes of the receiver and the attachment inserted therein.

* * * * *